US005852343A

United States Patent [19]

Ravi et al.

[11] Patent Number: 5,852,343

[45] Date of Patent: Dec. 22, 1998

[54] FLUORESCENT LAMP WITH ADJUSTABLE COLOR TEMPERATURE

[75] Inventors: Jagannathan Ravi, Bedford; Michael J. Shea, Beverly, both of Mass.; Joseph Connolly, Manchester, N.H.; Munisamy Anandan, Fishkill, N.Y.

[73] Assignee: Matsushita Electric Works Researches and Development Laboratory Inc., Woburn, Mass.

[21] Appl. No.: 779,982

[22] Filed: Dec. 23, 1996

[51] Int. Cl.[6] ..... H01J 1/62; H01J 63/04

[52] U.S. Cl. ..... 313/493

[58] Field of Search ..... 313/485, 486, 313/487, 493, 323, 324, 107

[56] References Cited

U.S. PATENT DOCUMENTS

| | | | |
|---|---|---|---|
| D. 198,268 | 5/1964 | Thorington et al. | D26/8 |
| 2,915,664 | 12/1959 | Lemmers | 313/109 |
| 2,950,410 | 8/1960 | Lemmers et al. | 313/109 |
| 2,973,447 | 2/1961 | Alcher et al. | 313/109 |
| 3,098,945 | 7/1963 | Lemmers | 313/109 |
| 3,560,786 | 2/1971 | Shurgan | 313/109 |
| 3,988,633 | 10/1976 | Shurgan et al. | 313/493 |
| 4,825,125 | 4/1989 | Lagushenko et al. | 313/493 |
| 5,384,519 | 1/1995 | Gotoh | 315/324 |
| 5,410,216 | 4/1995 | Kimoto et al. | 313/485 |
| 5,498,924 | 3/1996 | Northrop | 313/486 |

OTHER PUBLICATIONS

Aono et al., "Color Control of Fluorescent Lamps", *The 7th International Symposium on the Science & Technology of Light Sources —Symposium Proceedings* , p.81 (Aug. 1995).

Tanimizu et al, "Design Considerations for Color Temperature Variable Flourescent Lamps", *The 7th International Symposium on the Science & Technology of Light Sources – Symposium Proceedings* , p. 83 (August 1995).

*Primary Examiner*—William L. Oen

[57] ABSTRACT

A fluorescent lamp having an adjustable color temperature comprising at least two elongated fluorescent discharge tubes (10 & 20), one tube (10) having a larger diameter than the other (20). The tubes (10 & 20) are assembled into a single unit. A groove (12) is disposed within the larger tube (10) and runs parallel to the longitudinal axis. The smaller diameter tube (20) is snugly nested within the groove (12) and in intimate contact with the larger diameter tube (10). The larger diameter tube has a phosphor coating producing one color temperature and the smaller diameter tube produces a different color temperature. Preferably, the larger tube has a phosphor coating that emits a low color temperature of 3000° K. or below and the smaller tube's phosphor coating emits a high color temperature of greater than 10,000° K. A controller divides the power to the two tubes such that a variable color temperature is produced at nearly constant total power.

9 Claims, 1 Drawing Sheet

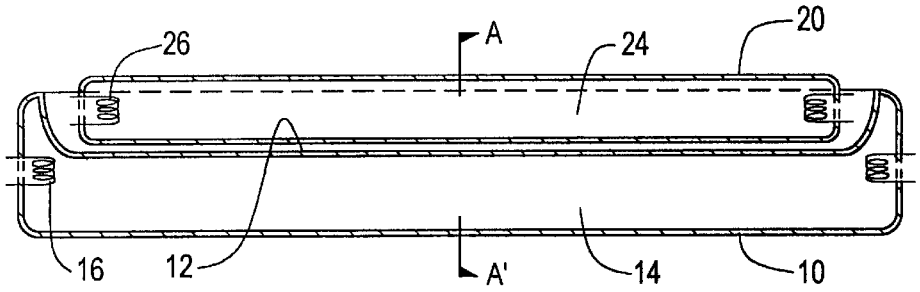
FIG. 1
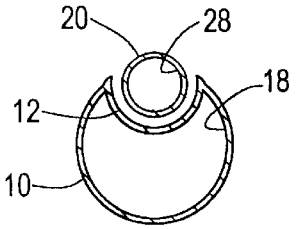
FIG. 2
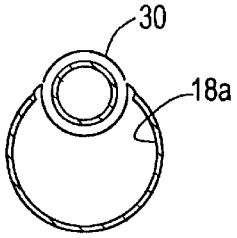
FIG. 3a
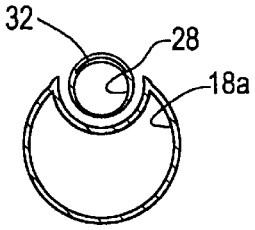
FIG. 3b
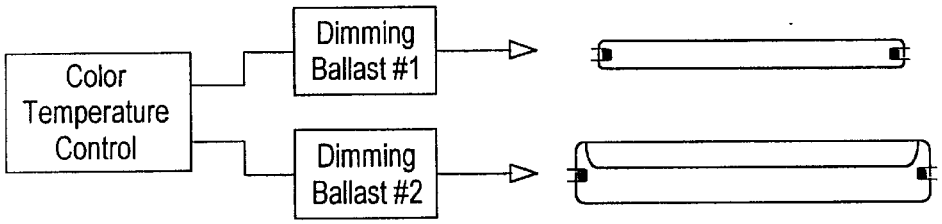
FIG. 4
FIG. 5a
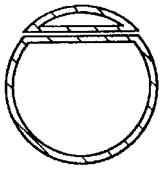
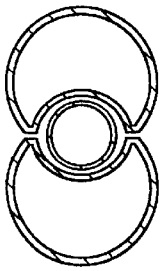
FIG. 5b

FLUORESCENT LAMP WITH ADJUSTABLE COLOR TEMPERATURE

FIELD OF INVENTION

This invention relates to fluorescent lamps having color temperatures that can be adjusted to suit the lighting requirements in a particular space or time. More particularly, it relates to fluorescent lamps and drive circuits which make substantial use of existing technology.

BACKGROUND OF THE INVENTION

Lamps for general illumination are designed to produce "white" light, i.e., their light emissions have a color spectrum or mix of colors that appear "white." In incandescent lamps, the filament is heated to a temperature of about 2800° K. in order to produce white light. An incandescent lamp gives out a continuous color spectrum which blend together to give white light. White light may also be produced by mixing a few specific colors such as red, green and blue. One characteristic of color is the "correlated color temperature," or more simply color temperature which is equivalent to the temperature of a black body source that matches that color. The color temperature of a white light source spans the range from about 2500° K. to 8000° K.; the preferred range is from 3000° K. to 6000° K.

The color temperature of a lamp is fixed at the time of manufacturing. In low pressure fluorescent lamps, the color temperature is determined by the phosphor coating on the bulb. Typically a few discrete color temperature choices are available such as "warm white" (3000° K.) "neutral" (3500° K.) "cool white" (4100° K.) and "daylight" (500° K.). The preference for a particular color temperature depends on a variety of psychological and evolutionary factors. People in northern latitudes favor warmer color temperatures, but tend towards the "cool white" for the work environment. Thus, in addition to human predisposition, color temperatures are kept different depending on the ambiance or mood of the living environment. A lighting system which allows the color temperature to be changed in a simple manner would allow the illumination needs of individuals to be met. The system would be flexible and will contribute to increased productivity and quality of life.

DESCRIPTION OF THE PRIOR ART

There have been many attempts to realize a practical variable color temperature fluorescent lamp. None of these has become commercially successful since, in all cases, the various schemes have not been economical, suitable for efficient manufacturing, or had performance limitations. The major schemes that have been proposed all use color mixing and can be divided into two categories: several individual lamps in a fixture or a single lamp that is pulse excited. The former method (see, for example, S. Gotoh, U.S. Pat. No. 5,384,519) requires at least three special lamps, control circuits and a dedicated fixture. The power is partitioned between the lamps in order to produce the desired color temperature. The single lamp category invariably requires the use of pulse excitation ballast circuits. In one device, neon is used as the fill gas. With suitable excitation, the red emission from neon mixes with the mercury/phosphor emissions to bring down the color temperature (M. Kimoto et al., U.S. Pat. No. 5,410,216). In another disclosed lamp, mercury and xenon UV radiation is generated using a pulse drive. The emissions from two different phosphors, each of which is sensitive to the mercury and xenon UV radiation, respectively, provide the color temperature variations (M. Aono et al., The 7th International Symposium on the Science & Technology of Light Sources). Yet another lamp with selective phosphors and pulse drive utilizes the UV radiation from mercury and argon to achieve color temperature variations (S. Tanimizu et al., The 7th International Symposium on the Science & Technology of Light Sources). An elegant approach using selective phosphors and a pulse drive to alter the ratio of only the mercury UV line intensities was recently filed (U.S. patent application Ser. No. 08/490,078). While all of the above approaches describe color temperature change in a single lamp, there are still hurdles to overcome, such as poor luminous efficacy, availability of special phosphors, the need for a complex and expensive ballast and poor lamp life due to the detrimental effect of pulsing on cathodes.

SUMMARY OF THE INVENTION

Therefore, it is a primary object of the present invention to furnish an adjustable color temperature lamp that will overcome the foregoing problems. Both the lamp and ballast circuit will be simple and inexpensive because it makes use of existing technology and does not require very special fixtures since the effect is achieved in a single lamp.

According to the present invention, the lamp consists of two discharge tubes integrally attached to each other. The larger discharge tube is coated with a phosphor that gives a low color temperature ("warm") while the smaller discharge tube which is substantially surrounded by the larger tube has a phosphor coating which gives a very high color temperature ("cool"). Because of the geometry of the arrangement, the light emission of the two tubes is well mixed. Each arc tube is driven by an appropriate dimming ballast and a controller ensures the partition of power between the two tubes so as to realize a desired color temperature.

BRIEF DESCRIPTION OF THE DRAWING

FIG. 1 is a simplified side cross-sectional view of the fluorescent lamp assembled from two discharge tubes. The phosphor coating is not illustrated in order to show construction details.

FIG. 2 is a cross-sectional view of the lamp shown in FIG. 1, taken on the line A–A'.

FIG. 3*a* and 3*b* are cross-sectional views showing two alternative embodiments of our invention which can enhance color mixing from the two discharge tubes.

FIG. 4 is a schematic block diagram of the lamp drive and control.

FIG. 5*a* and 5*b* are cross-sectional views showing two additional variations of the adjustable color temperature lamp configuration.

DESCRIPTION OF THE PREFERRED EMBODIMENT

The lamp comprises two discharge tubes as shown in FIGS. 1 and 2. The envelope material for the tubes is glass. A larger tube 10 has a groove 12 running along its back, parallel to its longitudinal axis. The smaller tube 20, which is cylindrical in cross-section, is located in the groove of the larger tube and is attached in place. Both tubes contain a fill, 14 and 24, of mercury and rare gas, typically argon, and are phosphor-coated on their inner walls for conversion of the mercury ultra violet radiation to visible light. The discharge tubes also have conventional electrodes 16 and 26 at each end. The two discharge tubes together thus form a single assembled lamp.

The groove on the larger tube does not extend all the way to the ends, since a circular cross-section at the ends facilitates the sealing of the stems which support the electrodes and the lead-in wires. The length of the smaller lamp should be such that it approximates the larger diameter lamp so that observable color difference of the two lamps is minimized. A cross-section of the lamp in the middle (Section A–A' of FIG. 1) is shown in FIG. 2. The groove 12 has a radius of curvature that is slightly larger than the outside radius of the tube 20. Further, the depth of the groove is such that the smaller tube 20 sinks in the groove at least to its diameter. In fact, it is advantageous if the smaller tube is submerged completely inside the groove. Besides the aesthetic appearance of a near round cross-section for the envelope of the lamp assembly, another desirable feature is that more radiation from the small tube is injected into the larger tube.

The variable color temperature feature of this lamp is achieved by color mixing of the light from the two discharge tubes. Accordingly, the phosphor blends in the two tubes are different. In FIG. 2, the larger tube has a phosphor coating 18 that converts the UV radiation to a "warm" color light of low color temperature (~2700° K.). For example, a blend of red and green phosphors such as Nichia NP92 might be used for this purpose. The other discharge tube then has to emit light of very high color temperature. In this embodiment, the phosphor coating 28 was a blend of blue and green phosphors, approximately in the proportion 70/30. The phosphor blends are chosen so that the emitted light lies substantially on the black body locus for all color temperatures.

It should be apparent that the sizes and geometries of the two discharge tubes shown should be chosen such that good color mixing is possible and the lamp is easy to fabricate. Except for the groove in the larger tube, all other steps involved in the lamp-making process are very similar or identical to those used in conventional fluorescent lamp manufacturing. Small variations may be introduced to realize better lamp performance, such as not coating the groove portion with phosphor, leaving a clear strip or strips, or coating the tube with a very thin layer in the groove portion to reduce the scattering of the light going from the smaller tube into the larger tube. The particular configuration of the coating is primarily determined by manufacturing ease and cost. Further, the bluish-green light emanating from the exposed top surface of the small tube can be redirected into the larger tube in order to realize a wider range of color temperature and more uniform appearance. This may be done in a special fixture. If, however, a standard fixture is to be used, then a reflecting surface may be incorporated in the top of the lamp assembly.

These embodiments are shown in FIG. 3*a* where the phosphor coating 18*a* is very thin or not present in the groove area. Portions of the curved surface 30 not within the groove have a highly reflecting surface that also improves the lamp appearance by hiding the smaller tube. Alternately, the light reflection from the top surface of the small tube may be accomplished by having an internal reflective coating 32 covering the upper half of the small discharge tube (FIG. 3*b*). The diameters of the two discharge tubes and the depth and shape of the groove are chosen such that the smaller tube is almost completely surrounded by the larger tube. An external reflector, if needed, should then be considerably smaller in size. A preferred embodiment is a 20 W/2 foot lamp as follows:

| | |
|---|---|
| Large discharge tube | T/8 or T/10, 24" long |
| Small discharge tube | T/4, 23" long |
| Color temperature range | 2700° K.–5500° K. |

The two-tube assembly lamp also will provide a better control of the cold spot temperature and, hence, to a great extent, ambient temperature insensitivity since the lamp is always operated at its rated power and the two discharge tubes are in good thermal contact with each other. In the system of the prior art which uses several lamps in a fixture to effect color temperature change, when some lamps are not operated at their individual rated powers, their cold spot temperatures can be much lower than optimal.

It should be pointed out that there are fluorescent lamps commercially available or described in the art that have a grooved pattern on top of the cylindrical envelope. The configurations shown have either continuous or a plurality of separate grooves of various cross-sections (see, for example, U.S. Design Pat. No. 198,268; U.S. Pat. Nos. 2,915,664; 2,950,410; 2,973,447; 3,098,945; 3,560,786; 3,988,633; 4,825,125; 5,498,924). The purpose of the grooves is mainly to raise the lamp voltage with an aim to increase the lamp luminous efficacy, or to make the lamp operable on a ballast designed for another lamp geometry, or to provide better control of the mercury vapor pressure. The grooves cause an increase of the lamp voltage due to one or all of these reasons: lengthening the path of the arc between the electrodes, increasing the wall recombination rate of the plasma ions with the phosphor and constriction of the plasma discharge.

While the grooved lamp of the present invention will also have a slightly higher voltage compared to a circular cross-section lamp of the same envelope diameter, the effect is incidental. Further, from a manufacturing point of view, the longitudinal groove parallel to the lamp axis in the present lamp is simpler in design and easier to fabricate than the groove patterns shown in the references cited before. As explained earlier, the presence of the groove allows a smaller diameter discharge tube to be nestled inside the large tube and thereby makes possible good color mixing of the light from the two tubes.

For color temperature variation, in addition to the lamp as described above, lamp power control is required. Each discharge tube is driven by a variable power (dimming) ballast. As an example, for the preferred embodiment detailed earlier, the larger tube may be operated from 20 W to 8 W, while the smaller tube is operated over the range 0 W to 12 W. The desired color temperature is set by a control unit that adjusts the power from the individual ballasts such that the total power to the lamp is constant (20 W). A block diagram schematic of the lamp drive and control is shown in FIG. 4. Again, the drive system for the two discharge tubes can use existing technology with only the addition of a proportioning controller. The power division between the two tubes gives rise to the color temperature variation.

This invention essentially discloses a color temperature variable fluorescent lamp that consists of two externally-assembled discharge tubes, one of which produces a "warm" color radiation and the other a "cool" color. It is also possible to reverse the "warm" and "cool" phosphor coatings on the two discharge tubes or to have different phosphor blends. Without deviating from the spirit of this invention, many variations may be thought of in the assembly, lengths, lamp powers, configurations, etc. Some of the many configurations possible are shown in FIG. 5.

While it is apparent that changes and modifications can be made within the spirit and scope of the present invention, it is our intention, however, only to be limited by the appended claims.

As our invention we claim:

1. A fluorescent lamp having an adjustable color temperature comprising:

at least two elongated fluorescent discharge tubes, each tube forming a lamp, one tube having a larger diameter than the other, said tubes being assembled into a single unit;

a groove disposed within the larger tube, said groove running parallel to the longitudinal axis;

the smaller diameter tube being snugly nested within said groove and in intimate contact with said larger diameter tube;

said larger diameter tube having a phosphor coating producing one color temperature and said smaller diameter tube producing a different color temperature.

2. The lamp according to claim 1 wherein said larger tube has a phosphor coating that emits a low color temperature of 3000° K. or below and said smaller tube's phosphor coating emits a high color temperature of greater than 10,000° K.

3. The lamp according to claim 1 wherein said smaller lamp is disposed at least to its diameter in said groove.

4. The lamp according to claim 1 wherein each discharge tube in the assembly is driven by a variable power ballast and further including a control unit for setting the operating points of the individual ballasts such that a desired color temperature is obtained at a nearly constant total power.

5. The lamp according to claim 1 wherein color mixing is enhanced by the groove portion of the larger diameter lamp being transparent or nearly transparent by coating only a very thin layer of phosphor or none on the inner surface thereof.

6. The lamp according to claim 1 wherein the groove of the larger lamp is transparent or nearly transparent and without or nearly without a phosphor coating thereon whereby to enhance color mixing.

7. The lamp according to claim 1 wherein color mixing is enhanced by directing light emanating from the exposed surface of the smaller diameter tube into the larger diameter tube by disposing either an internal or external reflective coating or layer on the exposed surface.

8. The lamp according to claim 1 wherein said lamp is substantially independent of the ambient temperature due to better cold spot temperature control.

9. The lamp according to claim 1 wherein the length of the smaller diameter tube is substantially the length of the larger diameter tube whereby the emission color of the lamp does not change significantly over the length of the lamp.

* * * * *